United States Patent [19]

Hertell

[11] Patent Number: 4,770,617

[45] Date of Patent: Sep. 13, 1988

[54] GEAR PUMP WITH LEAKAGE FLUID INTERMITTENTLY COMMUNICATED TO EXPANDING FLUID CELLS

[75] Inventor: Siegfried Hertell, Radevormwald, Fed. Rep. of Germany

[73] Assignee: Barmag AG, Remscheid, Fed. Rep. of Germany

[21] Appl. No.: 79,265

[22] Filed: Jul. 29, 1987

[30] Foreign Application Priority Data

Jul. 31, 1986 [DE] Fed. Rep. of Germany ..... 3625899
Feb. 13, 1987 [DE] Fed. Rep. of Germany ..... 3704549

[51] Int. Cl.[4] ..... F04C 2/18

[52] U.S. Cl. ..... 418/77; 418/79; 418/102; 418/131; 418/206

[58] Field of Search ..... 418/15, 77, 79, 102, 418/131, 205, 206; 425/376 B

[56] References Cited

U.S. PATENT DOCUMENTS

| | | | |
|---|---|---|---|
| 2,369,249 | 2/1945 | Rainalter | 418/206 |
| 3,447,472 | 6/1969 | Hodges et al. | 418/77 |
| 3,490,382 | 1/1970 | Joyner | 418/102 |
| 3,976,405 | 8/1976 | Geiger et al. | 418/102 |
| 4,392,798 | 7/1983 | Bowden | 418/102 |
| 4,515,512 | 5/1985 | Hertell et al. | 418/102 |

FOREIGN PATENT DOCUMENTS

| | | | |
|---|---|---|---|
| 062405 | 10/1982 | European Pat. Off. . | |
| 580019 | 8/1924 | France | 418/102 |
| 29137 | of 1913 | United Kingdom | 418/206 |

*Primary Examiner*—John J. Vrablik
*Attorney, Agent, or Firm*—Bell, Seltzer, Park & Gibson

[57] ABSTRACT

A gear pump is disclosed which is adapted to convey a polymeric melt without significant leakage, and which comprises a pair of intermeshing gears. One of the gears is driven by a drive shaft which extends through a journal bore in the pump housing, and a by-pass duct extends between the journal bore and an area in the internal chamber of the pump which is adjacent but spaced from the intermeshing teeth and where the fluid cells defined by the intermeshing teeth are expanding. Also, at least one root of one of the gears includes a channel which leads to the area of the by-pass duct, and so that an intermittent suction resulting from the expanding fluid cells acts to withdraw any melt from the journal bore of the drive shaft and through the by-pass duct, to thereby prevent leakage of the melt outwardly through the journal bore.

10 Claims, 2 Drawing Sheets

GEAR PUMP WITH LEAKAGE FLUID INTERMITTENTLY COMMUNICATED TO EXPANDING FLUID CELLS

BACKGROUND OF THE INVENTION

The present invention relates to a gear pump which is adapted to convey a heated polymeric material without significant leakage. More particularly, the present invention relates to a gear pump of the type which is adapted to be positioned downstream of a plastic extruder so as to serve as a booster or metering pump. Such pumps typically comprise a pair of intermeshing gears, with the gears being rotatably supported by shafts which are mounted in journal bearings, and with one of the shafts extending through the housing and serving as the drive shaft for transmitting torque to the gears.

In the plastic industry, particularly in the man made fiber industry, pumps of the described type are employed as metering pumps which are positioned downstream of an extruder which heats and melts the high polymer plastic and supplies the resulting melt under pressures of up to about 100 bar and higher to the pump. The pump in turn increases the pressure of the high polymer melt to the required spinning or extrusion pressure, which is typically several hundred bars, and then delivers the melt to the spinning or extruding nozzle. When manufactured with adequate precision, the pumps operate reliably and provide a highly accurate flow rate.

It is recognized that a minimum play is unavoidable between the moving parts of gear pumps, and on the high pressure side of the pump, the melt is caused to be forced into the narrow gaps between the sides of the gears and the opposing side wall surfaces of the housing, starting from about the area in which the teeth initially engage. As a result, the melt tends to flow into the bearings, and to flow outwardly through the bearing of the drive shaft. This plastic may pass through the shaft seal and lead to undesirable contamination and deposits, which result in breakdowns.

In the case of gear pumps which serve to deliver lubricating fluids, it has previously been suggested that a secondary flow be established in addition to the main flow for the purpose of maintaining an adequate lubrication of the gear bearings. The secondary flow is guided through the individual bearings, and a steady flow rate of the lubricant is therefore maintained. It has also been proposed to use the change from high pressure to lower pressure which occurs in the fluid cells formed by the intermeshing teeth, so as to produce such a lubricant flow, note for example U.S. Pat. Nos. 3,447,472 and 3,490,382, and EPO Pat. No. 062,405.

EPO Pat. No. 062,405 relates to an improvement of the bearing lubrication of a gear pump. On each pump side, the roller bearings are separated from the supported gears by wearing plates. The journal bores provided in the wearing plates are kept sufficiently large so as to enable a flow of the lubricant through the existing play between the journal shafts and the walls of the journal bores. On its side facing the gears, each wearing plate has a radial recess, which is positioned in the area of the engagement of the teeth on the pump intake side. These recesses are respectively associated with only one gear and are directed to the axis of the same, so that the one recess of the driven gear is associated with the other recess of the follower gear. Both recesses extend respectively from the journal bore for the shaft in the wearing plate and lead up to the area between the root circle and the addendum circle of the respectively associated gear. Another recess is provided on each side of the gears opposite to the first mentioned recesses, but on the outside of the wearing plates, and these further recesses lead from the pump intake up to the associated journal bore for the shaft.

The increasing, enclosed volume of the fluid cells results in that the thereby developed underpressure sucks, via the two recesses located directly adjacent the gear, the lubricant out of the gear bearing and delivers it to the pump intake. A cross connection to the neighboring bearing located on the same side of the pump results in that the underpressure in the first bearing is also operative in the second bearing and generates a suction there as well. This suction is filled on both sides from the pump intake via the recesses respectively located on the same pump side as the first recesses, but provided on the back side of the wearing plate. The described operation is identical on both pump sides.

The measures described in the above prior art reference are not suitable for eliminating the initially described problems in the processing of plastic melts or the like. More particularly, the described generation of secondary flows serving the lubrication would not provide the required accuracy in the case of metering pumps used in the processing of spinning melts and in which the flow of the melt delivered by the pump must be accurately maintained within very narrow limits. Further, the guarantee of an adequate lubrication of bearings is not a problem with which the present invention is concerned.

It is accordingly an object of the present invention to provide a gear pump of the type which is adapted to precisely meter the required flow of a heated plastic melt, and which avoids leakage of the melt from the pump.

It is also an object of the present invention to provide a gear pump of the described type which effectively avoids the deposit of the melt in the bearings, and in particular the bearing of the drive shaft, and which provides a means for removing any such melt which may enter into the shaft bearing.

SUMMARY OF THE PRESENT INVENTION

These and other objects and advantages of the present invention are achieved in the embodiment illustrated herein by the provision of a gear pump which comprises a housing having parallel side walls which define an interior chamber therebetween, and an inlet port and an outlet port. A pair of cooperating gears are rotatably mounted within the interior chamber of the housing, and the gears have intermeshing teeth which define fluid cells therebetween which contract and expand during rotation of the gears, and such that a melted polymeric material or the like may be conveyed from the inlet port at a relatively low pressure (which is above atmospheric pressure) to the discharge port at a relatively high pressure. A journal bore extends through one of the side walls of the housing, and a drive shaft extends through such one side wall and is rotatably received in the journal bore, and the shaft is operatively connected to one of the gears for transmission of rotational torque thereto. In accordance with the present invention, the gear pump further includes an inlet opening communicating with the journal bore, and duct means establishing intermittent communication between the inlet opening and the expanding fluid cells during rotation of the gears. By this arrangement, the expanding fluid cells create a suction which withdraws any plastic material from the journal bore and conveys the same into the expanding fluid cells and thus back into the interior of the housing.

The duct means includes a fluid duct which extends between the inlet opening in the journal bore and to an outlet opening which communicates with the side wall surface of one of the side walls of the housing at a location adjacent but spaced from the intermeshing teeth, and such that the outlet opening is normally closed by the adjacent side of one of the gears. Also, the outlet opening is located on the intake side of the pump and within the root circle on one of the gears. Further, the duct means includes at least one channel extending radially inwardly from the root of the adjacent gear, with the channel communicating with the side of such gear which is adjacent the outlet opening. Thus the channel intermittently overlies and communicates with the outlet opening of the duct means during rotation of the gears, and by this arrangement, intermittent communication is established between the inlet opening and at least one of the expanding fluid cells. While it is preferred that the outlet opening of the duct means be positioned on the intake side of the pump and within the root circle of the follower gear, it may also be located on the intake side of the pump and within the root circle of the driven gear.

Advantageously, the channel connecting the root with the outlet opening may be a groove extending from the associated root of the gear teeth radially inwardly toward the axis of the gear, with the groove being formed in the side of the gear facing the outlet opening. Also, the outlet opening is displaced from a plane extending through the two axes of the gears, and toward the axis of the gear provided with the channel, and it is preferably located at a point where the fluid cell to which it is connected has started to increase in volume, but is still securely closed. The angle by which the outlet opening is displaced from the above defined plane and toward the intake side should be smaller than about one-half the angle covering one tooth pitch, and at least about two degrees. Several flow channels may be evenly distributed over the periphery of the gear, so that each of several fluid cells is intermittently connected to the outlet opening of the duct means. In addition, the channels may each take the form of an enlargement at the associated root, and a relatively narrow groove extending radially inwardly from the enlargement.

In order to avoid having the side of the gear which is located opposite the drive shaft be axially biased from the opposite journal bearing by reason of the removal of the melt from the drive shaft bearing, and by the pressure which is operative on the opposite side, a second by-pass duct means may be advantageously provided which extends from the journal bore of the opposite shaft. The outlet opening of such second duct means is similarly located in the area of tooth engagement on the intake side of the pump, and within the root circle of one of the gears, and so that at least one fluid cell of the respective gear is intermittently connected with the second by-pass duct via a flow channel which communicates with the outlet opening during rotation of the gears. The arrangement of this second outlet opening within the root circle of the gear provides, according to the present invention, that a direct connection between the journal bearing to be relieved, and the pump, is avoided. Advantageously, the edge of the individual outlet opening, which is adjacent the pitch circle, is displaced from the root circle inwardly sufficiently far so that an effective seal against all root spaces which are not provided with a radial channel is insured.

From the above, it will be apparent that the present invention effectively insures that the leakage of the melt through the seal of the shaft bearing will be prevented. Thus, as a result of the effective separation of the flow of the fluid which is delivered by the pump, and the removal by suction of portions of the melt which enter the bearings, the normal operation of the pump is not jeopardized.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 3:
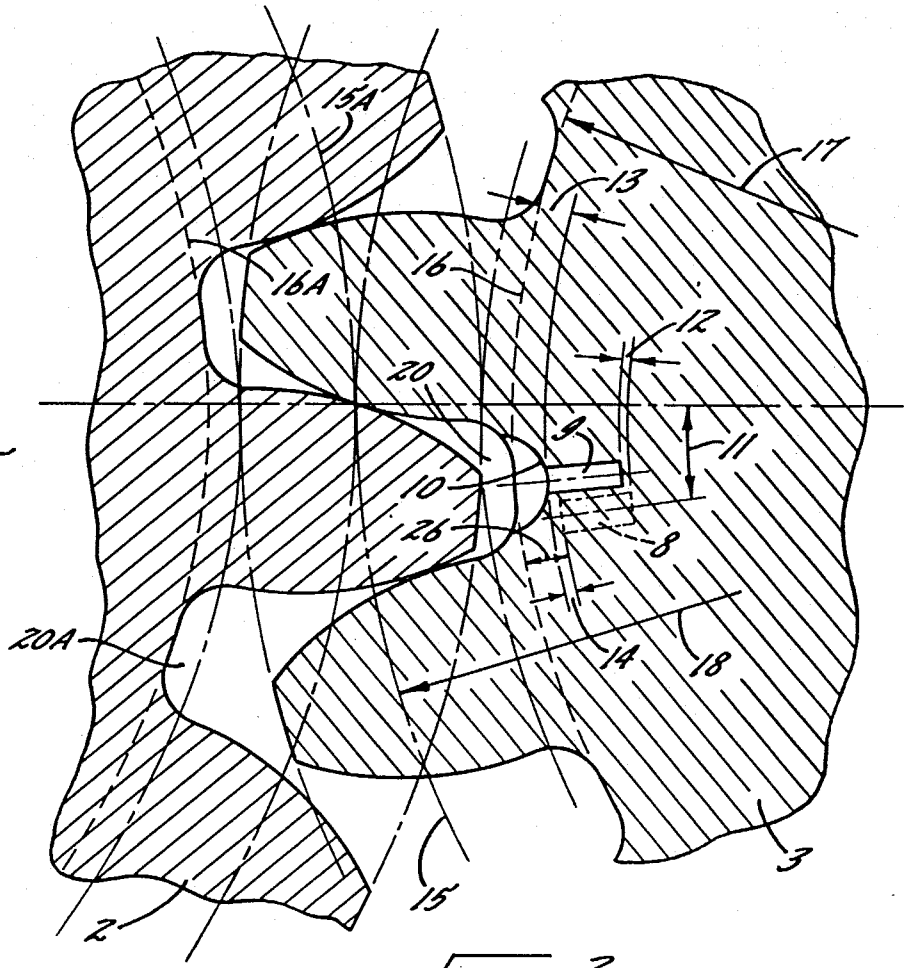
FIG. 3 is a fragmentary and enlarged view of the intermeshing teeth of the gear pump.

Referring more particularly to the drawings, a gear pump is illustrated which comprises a housing 1 having parallel side walls 21, 21A, which define an interior chamber therebetween. The side walls 21, 21A include wearing plates 22, 22A and 23, 23A which are positioned within the interior chamber, and the wearing plates 22, 23 define one interior side wall surface 41, and the plates 22A, 23A define an opposing interior side wall surface 42. Also, the housing 1 includes an inlet port 4, and an outlet port 5, note FIG. 1.

A pair of cooperating gears 2, 3 are rotatably mounted within the interior chamber of the housing, with the gear 2 being driven in the manner described below, and the gear 3 being a follower. Also, the gear 2 includes opposite parallel sides 32, 35 which are positioned closely adjacent the surfaces 41, 42 respectively, and the gear 3 includes opposite sides 31, 33 which are also positioned closely adjacent the surfaces 41, 42 respectively.

The gear 2 is rotatably supported by a drive shaft 27 on the side 32 thereof, and a coaxial supporting shaft 28 on the opposite side. Similarly, the gear 3 is supported by the shafts 43, 44. The shafts 27, 28 define a rotational axis 36 and are rotatably supported in corresponding journal bores 29, 30, which extend through the wearing plates 22, 22A. The shafts 43, 44 of the gear 3 define a rotational axis 37 and are rotatably supported in the journal bores 39, 40 which extend through the plates 23, 23A. The gear 2 is driven via the shaft 27, which extends outwardly through the side wall 21 of the housing, and the opening in the side wall 21 through which the shaft 27 extends is provided with a seal 25 which surrounds the shaft 27.

Figure 1:
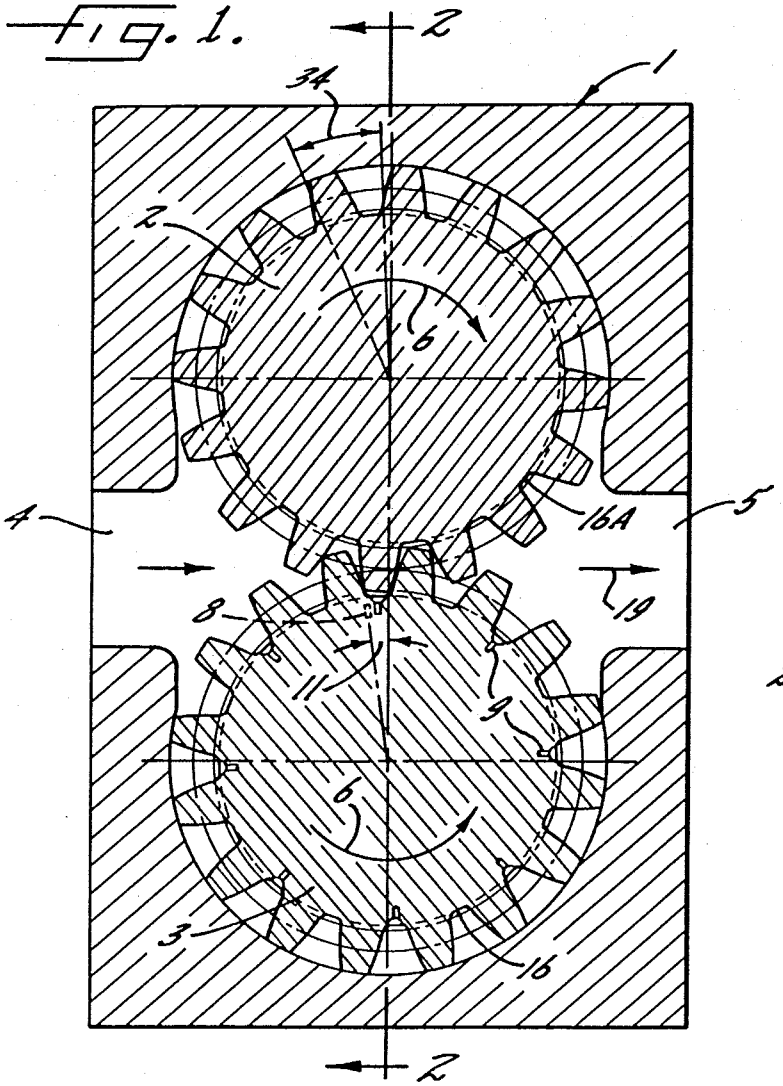
FIG. 1 is a sectional side elevation view of a gear pump which embodies the features of the present invention.

The arrows 6 in FIG. 1 illustrate the direction of rotation of the gears 2, 3. Accordingly, the flow of the melt enters through the inlet port 4, passes around the exterior of the gears, and exits through the outlet port 5. When serving as a booster or metering pump, the pump is positioned with its intake port 4 positioned downstream of a melt extruder, which delivers a flow of the melt such as a high polymer spinning melt, and which exits from the exterior at pressures above atmospheric pressure and up to about 100 bar or somewhat higher if necessary. The pump serves to accurately meter the melt to be delivered, and furthermore, it increases the pressure to the spinning or extrusion pressure, which may amount to several hundred bar. This high inside pressure causes the melt to enter into the very narrow spaces between the sides 31, 32, and 33, 35 of the two gears and the wearing plates 22, 22A, 23, 23A, and to flow outwardly along the journal bore 29 of the shaft 27.

In order to avoid having the spinning melt pass through the bore 29 of the shaft 27, there is provided a by-pass duct 6 which includes an inlet opening 45 which communicates with the journal bore, and an outlet opening 8 which communicates with the inner side wall surface 41. The inlet opening 45 is positioned between the seal 25 and the side 32 of the gear 2, and more particularly, it is positioned between the seal 25 and the wearing plate 22 in the illustrated embodiment. The outlet opening 8 is adjacent but radially spaced from the intermeshing teeth, and it is also located at a distance from the axis 37 of the gear 3 which is less than the root circle 16 of this gear. Also, the outlet opening 8 is displaced toward the suction or inlet port 4 of the pump. As can be seen in the drawings, the distance between the gear axis 37 and the outlet opening 8 is dimensioned so that its border adjacent the pitch circle 15 is at a distance 26 from the root circle 16 or the bottom of the roots of the gear 3. This distance 26 is preferably dimensioned so that it provides for an effective seal for the fluid cells 20 which are formed adjacent the root circle 16 by the intermeshing teeth.

To cooperate with the by-pass duct 6, the gear 3 is provided, in the illustrated embodiment, with several flow channels 9, which are evenly distributed over the periphery of the gear and extend radially inwardly from the respective roots at 16. The channels 9 are formed into the side 31 of the gear 3, and extend radially inwardly so as to substantially fully cover the outlet opening 8 of the by-pass duct 6. As an alternative to the radial channels 9, bores may be provided which also extend from the roots at 16 obliquely toward the side 31 of the gear.

It will be understood that portions of the delivered melt also tend to enter into the bearing bore 30 of the shaft 28, and which has a closed inner end at 24. Thus the inside pressure of the pump is also operative at the end 24 of the bore 30. If the side 32 of the gear 2 is relieved via the by-pass duct 6 and the flow channel 9, it will be unavoidable that the gear 2 will be subjected to an axial force which is exerted from the side of the bearing end 24. For this reason, a second by-pass duct 7 may be provided, which extends from the closed inner end 24 of the journal bore 30, and terminates at an outlet opening 38 in the side wall surface 42 of the plate 23A. Similarly, as with the side 31 and outlet duct 8, flow channels 9A are provided in the side 33 of the gear 3, and which extend radially inwardly from the roots at 16 and toward the axis 37, and so that the channels 9A are intermittently connected with the outlet opening 38. In this manner, the axial force exerted on the driven gear 2 at the bore end 24 is relieved.

Figure 2:
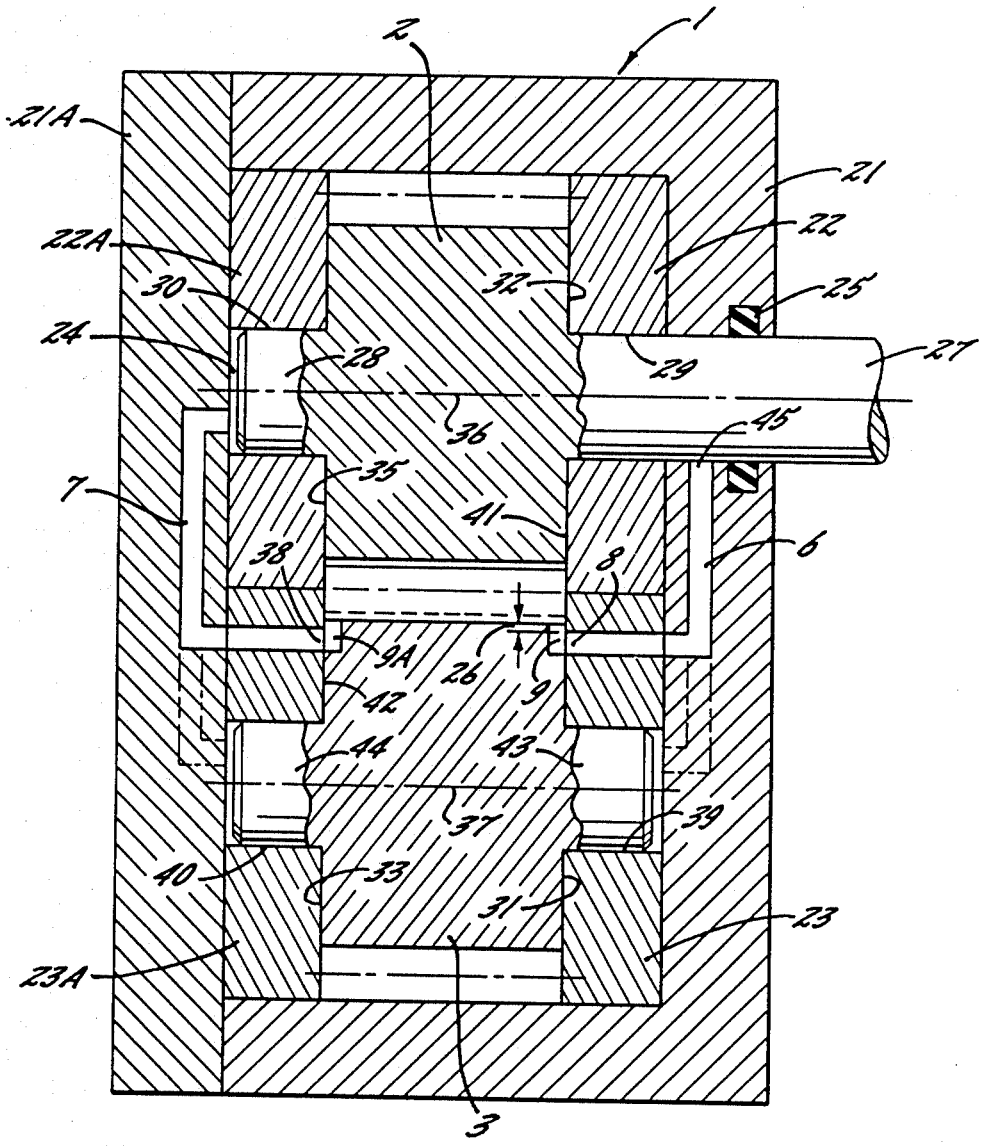
FIG. 2 is a front sectional view of the pump shown in FIG. 1, and taken substantially along the line 2—2 of FIG. 1.

In the embodiment illustrated in the drawings, the by-pass ducts 6 and 7 lead to the sides 31, 33 of the follower gear 3. Alternatively, it is possible to have the by-pass ducts 6 and 7 terminate within the root circle 16 of the driven gear 2, and in the side wall surfaces adjacent the same. In so doing, the flow channels 9 would proceed from the fluid cells 20A which are formed adjacent the root circle 16A of the gear 2. Similarly, when the need arises, it is possible to intermittently connect the ends of the journal bores 39, 40 of the follower gear 3 with the channels 9 and 9A, in a manner similar to the journal bore end 24, and via corresponding by-pass ducts. This arrangement is indicated in FIG. 2 by dashed lines, with the journal bore 39 being connected with the duct 6 and thus the outlet opening 8, and the journal bore 40 being connected with the duct 7 and thus the outlet opening 38.

The present invention makes use of the sharp pressure drop in the respective fluid cells 20, as they move from the pressure side 5 to the suction side 4, in the area of the intermeshing teeth. This pressure drop results from the fact that the fluid cells defined by the teeth first decrease in size and then increase. The pressure drop starts as the volume begins to increase, and this pressure drop is used for the purpose of relieving the journal bore 29 and possibly also the journal bore 30, as well as the journal bores 39 and 40 when desired. Since in a carefully manufactured pump, the portions of the melt entering into the journal bores is very small, it may suffice to provide for only one or a small number of flow channels 9. Also, it may be advantageous to have the fluid cells 20, 20A, and from which the flow channels proceed, include recesses or enlargements 10. The depth 13 of these enlargements, as measured from the root circle 16, is at most the same as the distance 26 between the outer boundary of the outlet opening 8 or 38 and the root circle 16, but preferably the depth 13 is smaller than the distance 26 by the amount 14.

The outlet opening 8 of the by-pass duct 6, as well as the opening 38 of the by-pass duct 7, are preferably displaced from the plane which includes the two gear axes 36, 37 and toward the suction side, by a distance represented by the angle 11. Thus the openings 8 and 38 are located in the area in which the fluid cells 20 are increasing in size, and the intermittent connection between the channels 9 or 9A and the by-pass ducts 6 or 7 is made when the suction exists in the associated fluid cell 20. Advantageously, the width of the flow channel 9 is, when measured in the circumferential direction, smaller than the corresponding width of the outlet opening 8 or 38.

The magnitude of the angle 11, by which the outlet opening is moved from the plane which includes the two gear axes 36, 37 also depends on whether the teeth of the meshing gears 2, 3 seal each individual fluid cell as they interengage over a certain angle of rotation, i.e. engage without play, or whether a slight play is provided between the meshing teeth, so that each associated closed fluid cell comprises two adjacent fluid cells 20, 20A, with one associated with the gear 2 (20A) and the other with the gear 3 (20). In the first case, an angle 11 as small as about 2° will suffice, since as the fluid cell 20 moves across the plane of the axes 36, 37 toward the intake side 4, the increase of the fluid cell 20 and thus the suction starts. However, in the second case, the angle must be somewhat larger, so that as the coverage of the flow channel 9 and the outlet opening 8 starts, the fluid cell 20 has already reached a somewhat greater volume than the fluid cell 20A, and preferably, the fluid cell 20A of the gear 2 will have moved at least half way through the plane of the axes 36, 37. Accordingly, it will be seen that the angle 11 should not be greater than about one-half the angle 34 covering a complete tooth pitch, but not smaller than about 2°. In gear pumps in which the teeth mesh with a slight play, i.e., in which two fluid cells 20, 20A form a volume together, the angle 11 preferably has a value which corresponds to at least one-fourth of the angle 34. In this instance, it has also been found advantageous that the outlet opening 8 or 38, extends by a small amount 12 further toward the gear axis 37, 36 than does the radial channel 9.

The determination of the number of flow channels 9 or 9A to be provided over the circumference of the gear depends on the leakage which actually occurs, and should, if possible, be designed so that the actual leakage is not exceeded, or only slightly exceeded, by the suction capacity. In an arrangement having by-pass ducts for the two journal bores 29, 30, or all four journal bores, it may be desirable to also provide for a separation of the flow channels 9, 9A, i.e., the flow channels are associated with different fluid cells. In the event flow channels are provided for both gears, it is also preferable that they be sealed from each other so that they proceed from different fluid cells. By this arrangement, it will be possible to associate each journal bore with an individually dimensioned intake path. Also, it will then be advantageous to use gears which mesh without play.

In the drawings and specification, there has been set forth a preferred embodiment of the invention, and although specific terms are employed, they are used in a generic and descriptive sense only, and not for purposes of limitation.

I claim:

1. A gear pump adapted to convey a melted polymeric material or the like without significant leakage thereof, and comprising a housing having parallel side walls which include opposing side wall surfaces and an interior chamber therebetween, and an inlet port and an outlet port, a pair of cooperating gears rotatably mounted within said interior chamber of said housing and defining a driven gear and a follower gear, said gears having parallel opposite sides which are positioned immediately adjacent respective ones of said opposing side wall surfaces of said housing, and said gears further having intermeshing teeth which define fluid cells therebetween which contract and expand during rotation of said gears and such that a melted polymeric material or the like may be conveyed from said inlet port at a relatively low pressure to said discharge port at a relatively high pressure, a journal bore extending through one of said side walls of said housing, a drive shaft extending through said one side wall and being rotatably received in said journal bore, with said shaft being operatively connected to said driven gear for transmission of rotational torque thereto, a fluid duct which includes an inlet opening which communicates with said journal bore and an outlet opening which communicates with the side wall surface of said one side wall of said housing at a location adjacent but spaced from said intermeshing teeth and such that said outlet opening is normally closed by the adjacent side of one of said gears, and channel means formed in said one of said gears for intermittently interconnecting said outlet opening of said fluid duct with the expanding fluid cells during rotation of said gears, and such that the expanding fluid cells create a suction which withdraws any plastic material in said journal bore and conveys the same into said expanding fluid cells and thus back into said interior chamber of said housing.

2. The gear pump as defined in claim 1 wherein said outlet opening of said fluid duct is located radially inside of the root circle of said one of said gears, and wherein said channel means comprises at least one channel extending radially inwardly from the root formed between the teeth of said one gear and with said channel communicating with the side of said one gear which is adjacent said outlet opening of said fluid duct, and with said channel extending radially inwardly a distance sufficient to intermittently overlie said outlet opening of said fluid duct during rotation of said gears.

3. The gear pump as defined in claim 2 wherein said at least one channel comprises a groove extending radially inwardly from the associated root along the side of said one gear which is adjacent said outlet opening of said fluid duct.

4. The gear pump as defined in claim 3 wherein said gears define parallel rotational axes, and wherein said rotational axes define a plane which extends transversely between said inlet and outlet ports, and wherein said outlet opening of said fluid duct is offset from said plane in a direction toward said inlet port.

5. The gear pump as defined in claim 4 wherein the distance between said outlet opening of said fluid duct and said plane is less than about one half the tooth pitch of the teeth of said one gear.

6. The gear pump as defined in claim 4 wherein the teeth of said one gear define a tooth angle about the rotational axis thereof and which covers one tooth pitch, and wherein said outlet opening of said fluid duct and said plane define an angle about the rotational axis of said one gear which is less than about one-half said tooth angle and is at least about two degrees.

7. The gear pump as defined in claim 2 wherein said channel means comprises a plurality of said channels which are evenly distributed about the periphery of said one gear.

8. The gear pump as defined in claim 7 wherein each of said channels comprises an enlargement at the associated root, and a relatively narrow groove extending radially inwardly from said enlargement.

9. The gear pump as defined in claim 1 wherein said pump comprises a second journal bore within the opposite side wall of said housing and which has a closed inner end, and with said second journal bore being coaxially aligned with said first mentioned journal bore, and a support shaft rotatably received in said second journal bore and coaxially fixed to said driven gear, a second fluid duct which includes a second inlet opening which communicates with said closed inner end of said second journal and a second outlet opening which communicates with the side wall surface of said opposite side wall of said housing at a location adjacent but spaced from said intermeshing teeth and such that said second outlet opening is normally closed by the adjacent side of said one of said gears, and second channel means formed in said one of said gears for intermittently interconnecting said second outlet opening with the expanding fluid cells during rotation of said gears, and such that the expanding fluid cells create a suction which withdraws any plastic material in said second journal bore and conveys the same into said expanding fluid cells and thus back into said interior chamber of said housing.

10. A gear pump as defined in claim 9 further comprising third and fourth journal bores positioned in respective side walls of said housing and coaxially aligned along the axis of said follower gear, and a pair of mounting shafts coaxially fixed to said follower gear and being rotatably received in respective ones of said third and fourth journal bores, a third fluid duct communicating between said third journal bore and said first mentioned fluid duct, and a fourth fluid duct communicating between said fourth journal bore and said second fluid duct, whereby any plastic material in said third and fourth journal bores is withdrawn into the expanding fluid cells and thus back into said interior chamber of said housing.

* * * * *